US011274381B2

(12) United States Patent
Liu et al.

(10) Patent No.: US 11,274,381 B2
(45) Date of Patent: Mar. 15, 2022

(54) FUSIBLE BICOMPONENT SPANDEX

(71) Applicant: The LYCRA Company LLC, Wilmington, DE (US)

(72) Inventors: Hong Liu, Waynesboro, VA (US); Steven Wayne Smith, Waynesboro, VA (US); Achille Mayelle Bivigou Koumba, Charlottesville, VA (US); Geoffey Davis Hietpas, Newark, DE (US); Willem Bakker, Divonne (FR); Andreas J. Blab, Kennett Square, PA (US); Tianyi Liao, Chadds Ford, PA (US); Lijuan Pi, Newark, DE (US)

(73) Assignee: THE LYCRA COMPANY LLC, Wilmington, DE (US)

( * ) Notice: Subject to any disclaimer, the term of this patent is extended or adjusted under 35 U.S.C. 154(b) by 0 days.

(21) Appl. No.: 14/952,192

(22) PCT Filed: May 29, 2014

(86) PCT No.: PCT/US2014/039991
§ 371 (c)(1),
(2) Date: Nov. 25, 2015

(87) PCT Pub. No.: WO2014/194070
PCT Pub. Date: Dec. 4, 2014

(65) Prior Publication Data

US 2016/0122907 A1 May 5, 2016

Related U.S. Application Data

(60) Provisional application No. 61/828,344, filed on May 29, 2013.

(51) Int. Cl.
*D01F 8/16* (2006.01)
*D04H 3/009* (2012.01)
(Continued)

(52) U.S. Cl.
CPC ..... *D01F 8/16* (2013.01); *D02G 3/328* (2013.01); *D02G 3/402* (2013.01); *D03D 15/47* (2021.01);
(Continued)

(58) Field of Classification Search
CPC ..... D01F 8/00; D01F 8/04; D01F 8/16; D01F 9/245; D01F 6/70; D03D 15/0027;
(Continued)

(56) References Cited

U.S. PATENT DOCUMENTS 149,734 A 4/1874 Evarts
6,207,276 B1 3/2001 Spindler et al.
(Continued)

FOREIGN PATENT DOCUMENTS

CN 102257195 12/2014
EP 0454160 A2 * 10/1991 ..... D01F 8/16
(Continued)

OTHER PUBLICATIONS

Kipp, Dale O. Plastic Material Data Sheets. MatWeb, LLC.. Online version available at: https://app.knovel.com/hotlink/toc/id:kpPMDS0001/plastic-material-data/plastic-material-data (Year: 2010).*

(Continued)

*Primary Examiner* — Vincent Tatesure
(74) *Attorney, Agent, or Firm* — Bridget C. Sciamanna; Kathleen A. Tyrrell

(57) ABSTRACT

Included are segmented polyurethane elastic fibers or spandex fibers, capable of bonding to polymer fiber such as nylon or polyamide fibers, in addition to bonding to itself, for apparel textile applications. More particularly the invention relates to bicomponent spandex fibers, with a heat resistant core and a heat sensitive sheath, spun from polymer solutions. The nylon fabrics containing such spandex fibers have
(Continued)

enhanced stretch performance and improved surface appearance after heat treatment to activate the fusing and bonding between nylon fibers and spandex fibers.

17 Claims, 1 Drawing Sheet

(51) Int. Cl.

| | |
|---|---|
| ***D04H 3/147*** | (2012.01) |
| ***D04B 1/18*** | (2006.01) |
| ***D04B 21/18*** | (2006.01) |
| ***D02G 3/40*** | (2006.01) |
| ***D02G 3/32*** | (2006.01) |
| ***D03D 15/47*** | (2021.01) |
| ***D03D 15/56*** | (2021.01) |

(52) U.S. Cl.
CPC ..... *D03D 15/56* (2021.01); *D04B 1/18* (2013.01); *D04B 21/18* (2013.01); *D04H 3/009* (2013.01); *D04H 3/147* (2013.01); *D10B 2201/02* (2013.01); *D10B 2331/02* (2013.01); *D10B 2331/10* (2013.01); *D10B 2401/041* (2013.01)

(58) Field of Classification Search
CPC ..... D03D 15/08; D04H 3/147; D04B 1/18; D10B 2331/10; D10B 2401/061
USPC ..... 442/199–202, 311, 361–365, 182, 184, 442/306, 328, 329, 361–365; 428/373–374
See application file for complete search history.

(56) References Cited

U.S. PATENT DOCUMENTS

| | | | | |
|---|---|---|---|---|
| 8,173,558 | B2 | 5/2012 | Fukuoka et al. | |
| 9,435,059 | B2 | 9/2016 | Smith et al. | D04B 1/18 |
| 2002/0022670 | A1* | 2/2002 | Poessnecker | C08G 69/02 516/172 |
| 2006/0030229 | A1 | 2/2006 | Fukuoka et al. | |
| 2006/0057379 | A1 | 3/2006 | Inagaki | |
| 2008/0070465 | A1 | 3/2008 | Wiles | |
| 2011/0275265 | A1 | 11/2011 | Smith et al. | |
| 2011/0283435 | A1* | 11/2011 | Smith | D01F 1/10 2/69 |
| 2012/0034834 | A1 | 2/2012 | Smith et al. | |
| 2015/0044448 | A1* | 2/2015 | Smith | D01F 1/10 428/221 |

FOREIGN PATENT DOCUMENTS

| | | | | |
|---|---|---|---|---|
| JP | 2009-24321 | | 2/2009 | |
| WO | 2010/045637 | A2 | 4/2010 | |
| WO | 2010/045637 | A3 | 8/2010 | |
| WO | 2011/052262 | A1 | 5/2011 | |
| WO | 2011/149734 | A2 | 12/2011 | |
| WO | WO-2011149734 | A2 * | 12/2011 | D01F 1/10 |
| WO | 2014/194070 | A1 | 12/2014 | |

OTHER PUBLICATIONS

Siggia, S., "Quantitative Organic Analysis via Functional Group", 3rd Edition, Wiley & Sons, New York, 1963, pp. 559-561.
International Search Report and Written Opinion Received for PCT Application No. PCT /US2014/039991, dated Sep. 23, 2014, 18 pages.
International Preliminary Report on Patentability Report Received for PCT Patent Application No. PCT/US2014/039991, dated Dec. 10, 2015, 15 pages.

* cited by examiner

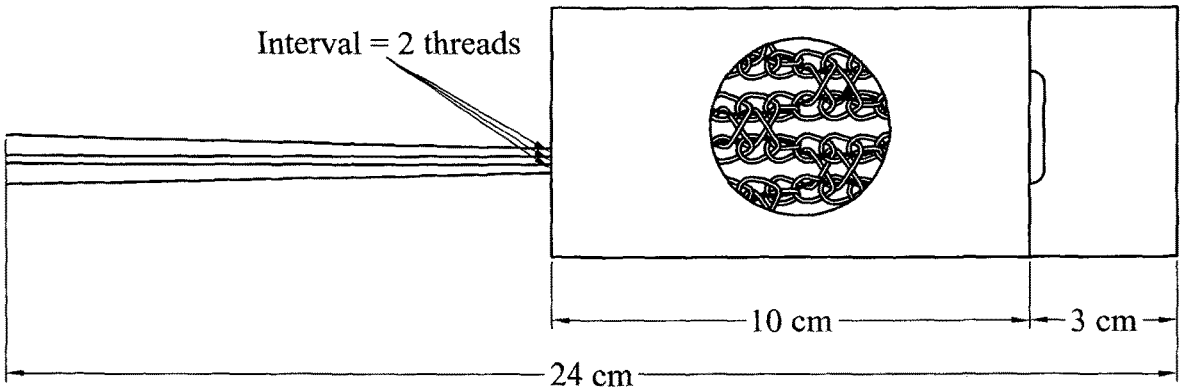
Interval = 2 threads
10 cm
3 cm
24 cm

FUSIBLE BICOMPONENT SPANDEX

BACKGROUND OF THE INVENTION

1. Field of the Invention

The present invention relates to segmented poly-urethane elastic fibers or spandex fibers, capable of bonding to polymer fiber such as nylon or polyamide fibers, in addition to bonding to itself, for apparel textile applications. More particularly the invention relates to bicomponent spandex fibers, with a heat resistant core and a heat sensitive sheath, spun from polymer solutions. The nylon fabrics containing such spandex fibers have enhanced stretch performance and improved surface appearance after heat treatment to activate the fusing and bonding between nylon fibers and spandex fibers.

2. DESCRIPTION OF THE RELATED ART

With superior durability, strength, softness and lustrousness, nylon fabrics have long been used as a base apparel textile material. The addition of spandex fibers in nylon based fabrics further provides the fabrics with elasticity and comfort, making them extremely popular in close-to-body applications such as intimate apparel, shapewear, swimwear and sportswear in addition to legwear/hosiery. In these applications, higher fabric recovery power with lower fabric weight is highly desired to keep the body contour shape without sacrificing wear comfort and mobility.

In addition, during cutting and sewing process of nylon fabrics with spandex yarns, the elastomeric yarn can often be pulled away from the seams under repeatedly, so called "slip in" or seam slippage, and this phenomenon can lead to the loss in stretch of fabrics and poor fabric uniformity appearance due to uneven density.

Significant efforts have been devoted to develop fabrics with elastomeric yarns fusible to itself and to the companion hard yarns upon fabric heat treatment such as steam setting and heat setting processes. U.S. Patent Application 20060030229A1 discloses a polyurethane based melt spun fiber having the melting temperature of 180° C. or below for woven or knitted fabrics. Dry heat treatment at 150° C. for 45 seconds at 100% extension could make this polyurethane elastomeric fiber fused to each other or to other elastic or non-elastic filaments at crossover points. U.S. Pat. No. 8,173,558B2 also discloses weft knitted fabrics including such a polyurethane elastomer fiber. Because of the low melting point and poor heat resistance of such kind of polyurethane elastomeric fibers, they lose excessive fiber tenacity and result in filament breaks and fabric recovery power loss, when the fabrics are treated in a typical range of heat set temperatures of 190° C. to 200° C. required to provide the dimensional stability for nylon based fabrics. On the other hand, under the heat treatment at a temperature lower than 180° C., no adequate fusibility can be developed between these melt-spun elastomeric fibers and the nylon fibers.

U.S. Pat. No. 6,207,276B1 describes a melt spun sheath-core bicomponent fiber, significant parts of which include polyamide or nylon, for paper machine felt applications. No disclosure is provided for fibers in apparel fabric applications or in combination with spandex fibers. Similarly, in the product catalog from EMS-CHEMIE AG, a sheath-core bicomponent fiber, including a nylon-6 core of melting temperature at 220° C. and a copolyamide sheath of melting temperature at 135° C. is listed, however, no disclosure of apparel textile applications or the possibility of fusibility with spandex fibers is provided.

PCT Patent Application WO2011052262A1 also discloses a melt spun sheath-core conjugate thread with a polyurethane core, prepared from an isocyanate-terminated prepolymer and a hydroxyl-terminated prepolymer, and an elastomer core selected from polyester or polyamide based elastomer. Nylon fabrics containing such conjugate fiber again will lose significant power due to poor heat resistance under the heat setting conditions required to achieve acceptable fabric appearance and shrinkage.

U. S. Patent Application 20120034834A1 discloses a dry spun fusible sheath-core bicomponent spandex fiber with at least one low temperature melting polyurethane as the fusibility improvement additive in the sheath. Such additives based on low temperature melting polyurethanes certainly improve the fusibility of spandex fiber to itself.

SUMMARY OF THE INVENTION

None of the previously provided solutions provide an elastomeric fiber that solves the problem of providing a dimensionally stable fabric that provides adequate elasticity and resists seam slippage. Accordingly, an elastomeric fiber or spandex fiber that can withstand the heat treatment under nylon fabric heat setting conditions without excessive loss of recovery power and which is capable of bonding to the nylon fiber for enhanced fabric power and appearance is still needed.

It has been well recognized that segmented polyurethaneurea based spandex fibers have superior elastic properties and thermal resistance compared to thermoplastic polyurethane elastomer based spandex fibers. In fact, because of the high crystallinity and high melting temperature of the urea hard segment domains, it is virtually impossible to melt-spin a spandex fiber based on a polyurethaneurea polymer without encountering severe degradations. That is the fundamental reason why polyurethaneurea based spandex fibers are spun by solution spinning processes, either through wet-spinning or by dry-spinning, in commercial productions and these spandex fibers can withstand the high temperature treatment such as heat setting for nylon fabrics without losing excessive recovery power. It is also recognized that such heat resistant polyurethaneurea spandex fibers have poor fusibility to nylon fibers even under the high temperature treatment. Therefore, a technical solution is needed to produce an elastomeric fiber or spandex fiber capable of bonding to the nylon fiber in a fabric and yet without losing excessive fabric recovery power under the thermal treatment conditions required for nylon fabric appearance uniformity and dimensional stability.

One aspect provides an article including a bicomponent spandex yarn which is fusible to other yarns including other polymer yarns such as polyamide or nylon. The bicomponent spandex yarn includes: (a) a polyurethane bicomponent fiber including a cross-section having a core and a sheath; and (b) the sheath includes a hot melt adhesive, such as a polyamide hot melt adhesive. The article may be a yarn, a fabric or a garment.

One aspect provides a solution spun sheath-core bicomponent spandex fiber, with a heat resistant core and a heat sensitive sheath, capable of bonding to nylon fiber in a fabric upon heat treatment without excessive loss of recovery power. The sheath-core bicomponent fiber, including yarn and thread, can be multi-filaments or single filament, and each filament can be concentric, eccentric or irregular shape. In each filament, (a) the core component includes at least one segmented polyurethaneurea with the hard segment melt temperature no less than 250° C., and the sheath component includes at least one polyamide based hot melt adhesive with the melting temperature no higher than 180° C.;
(b) the core component has at least 60% by weight of a segmented polyurethaneurea or polyurethaneurea mixture and the sheath component has at least 25% by weight of a polyamide based hot melt adhesive in form of homopolymer, copolymer, terpolymer or polymer blends;
(c) and the core component is at least about 80% by weight and sheath component is no more than about 20% by weight.

A further aspect provides a process for preparing a fusible bicomponent spandex yarn. The process including:

(a) providing a core polymer compositions including a first polyurethane solution
(b) providing a sheath polymer composition including a second polyurethane solution including a hot melt adhesive;
(c) combining the core and sheath compositions through distribution plates and orifices to form filaments having a sheath-core cross-section;
(d) extruding the filaments through a common capillary; and
(e) removing solvent from said filaments.

Another aspect provides a fabric, formed by knitting or weaving, including at least one nylon or polyamide fiber and at least one fusible bicomponent spandex fiber. The nylon fiber can be used directly in combination with a fusible bicomponent spandex fiber, or it can be used as a nylon-covered spandex yarn, in making the fabrics. The nylon fiber can be fused to the spandex fiber upon heat treatment of the fabric so that the fabric power is enhanced comparing to that without bonding between the nylon fiber and the spandex fiber. In addition, such fused fabric structure also prevents the seam slippage of the spandex fiber in repeated stretch cycles. More specifically, the fused contact points or sections between nylon filament and spandex filament are comprised of at least one polyamide hot melt adhesive with the melting temperature no higher than 180° C.

Also provided is an article including a fabric including a polyamide fusible sheath-core bicomponent spandex fiber. The polyamide fusible sheath-core bicomponent spandex fiber may be bonded to other yarns in the fabric upon heat-setting or other heat treatment.

A process for preparing a fabric is provided, the process including:

(a) providing a polymer yarn,
(b) providing a polyamide fusible sheath-core bicomponent spandex fiber;
(c) combining the polyamide yarn and said bicomponent spandex fiber to form a fabric; and
(d) fusing the polyamide yarn to the bicomponent spandex within the fabric by exposing the fabric to a temperature from about 150° C. to about 200° C.

BRIEF DESCRIPTION OF THE DRAWING

FIG. 1 is a diagram of a method for testing seam slippage resistance.

DETAILED DESCRIPTION

Definitions

A fiber is defined herein as a shaped article in form of thread or filament with an aspect ratio, the ratio of length to diameter, of more than 200. A "fiber" can be single filament or multifilament, and can be used interchangeably with a "yarn".

A nylon fiber as used herein means a manufactured fiber in which the fiber-forming substance is a long-chain synthetic polyamide in which less than 85% percent of the amide linkages are attached directly to two aromatic rings.

A bicomponent fiber is defined as a fiber with each filament having two separate and distinct regions of different compositions, which may be different polyurethane compositions. The separate compositions, such as core and sheath, of the fiber may be extruded from the same capillary into a single filament. The core and sheath have a discernible boundary, i.e., two regions of different compositions that are continuous along the fiber length. The term "conjugate fiber" can be used as synonymous with a bicomponent fiber. The cross-section may be round or non-round.

A sheath-core bicomponent fiber means a bicomponent fiber where one of the components (core) is fully surrounded by the second component (sheath). The cross-section shape or the relative position of each component is not critical.

As used herein, "solvent" refers to an organic solvent used for at least one or both of the bicomponent, such as dimethylacetamide (DMAC), dimethylformamide, (DMF) and N-methylpyrrolidone, which can form a homogeneous solution for the polymers and additives.

An additive is defined herein as a substance added in the fiber in small amount to improve the appearance, performance and quality in manufacture, storage, processing and use of the fiber. An additive by itself is not capable of fiber forming.

The term "other polymers" as used herein means any polymeric materials, other than specified, with the number average molecular weight higher than 500 dalton. These polymers may be or may not able to form a fiber by itself.

The term "solution-spinning" as used herein includes the preparation of a fiber from a solution which can be either a wet-spun or dry-spun process, both of which are common techniques for fiber production.

A "polyamide hot melt adhesive" as used herein is defined as a thermoplastic polymer with repeated amide groups which can be melted or soften by heat and then adhered to another substrate upon cooling. Additives such as antioxidant, tackifier and plasticizer can be included, however, the polyamide based polymer must be the dominant component in the polyamide hot melt adhesive.

The term "melting temperature" as used herein is defined as the endothermic peak position by differential scanning calorimetry for a thermal transition from crystalline domains to amorphous state. This transition can be reversible or irreversible.

The bicomponent spandex fiber of some aspects has sheath-core bicomponent configuration and meets the definition of "a manufactured fiber in which the fiber-forming substance is a long chain synthetic polymer comprised of at least 85% of a segmented polyurethane". That means that the combined segmented polyurethane content in sheath and in core of the inventive fiber is at least 85% by weight of the fiber. This level is required to maintain the stretch and recovery performance of the fiber, characterized by a spandex fiber. The elastic properties and the retention of the elastic properties after heat treatment of a spandex fiber are very much dependent on the content of the segment polyurethane, and the chemical composition, the micro domain structure and the polymer molecular weight of the segment polyurethane. As it has been well established, segmented polyurethanes are one family of long chain polyurethanes including hard and soft segments by step polymerization of a hydroxyl-terminated polymeric glycol, a diisocyanate and a low molecular weight chain extender. Depending on the nature of the chain extender used, a diol or a diamine, the hard segment in the segmented polyurethane can be urethane or urea. The segmented polyurethanes with urea hard segments are categorized as polyurethaneureas. In general, the urea hard segment forms stronger inter-chain hydrogen bondings functioning as physical cross-link points, than the urethane hard segment. Therefore, a diamine chain extended polyurethaneurea typically has better formed crystalline hard segment domains with higher melting temperatures and better phase separation between soft segments and hard segments than a short chain diol extended polyurethane. Because of the integrity and resistivity of the urea hard segment to thermal treatment, polyurethaneurea can only be spun into fibers through solution spinning process.

The sheath and core of the sheath-core bicomponent spandex fiber are prepared separately and include independently selected polyurethane compositions. This means that the composition of the sheath and core may include similar or different component depending on the desired properties of the fiber. For example, the core and the sheath may both include a polyurethane-urea. The core and the sheath may each independently include: (1) a polyurethane, (2) a blend of at least one polyurethane and at least one polyurethane-urea or, (3) a polyurethane-urea.

One aspect provides a solution spun sheath-core bicomponent spandex fiber, with a heat resistant core based on polyurethane such as polyurethaneurea predominantly and a heat sensitive sheath including polyurethane and a polyamide hot melt adhesive, so that the thus formed spandex fiber is capable of bonding to nylon fiber or other fibers in a fabric upon heat treatment without losing excessive stretch elongation and recovery power. The sheath-core bi-component fiber, including yarn and thread, can be multi-filaments or single filament, and each filament can be concentric, eccentric or irregular shape.

The core component includes at least one segmented polyurethaneurea with the hard segment melt temperature no less than 250° C. The core component may be in an amount of at least about 80% by weight of the fiber, such as from about 80% to about 95% by weight of the bicomponent spandex fiber. The core component has at least 60% by weight of a segmented polyurethaneurea or polyurethaneurea mixture, The sheath component includes a polyurethane composition and at least one polyamide based hot melt adhesive. The polyurethane may be any described herein, such as a polyurethane urea, and mixtures thereof. The hot melt adhesive is described in greater detail hereinbelow. Suitable melting temperature for the hot melt adhesive is no higher than 180° C. Suitable melting temperatures for the hot melt adhesive include about 120° C. to about 180° C. The sheath component may be from about 5% to about 20% by weight of the bicomponent spandex fiber. The sheath component includes a polyurethane such as a polyurethaneurea and has at least 25% by weight of the sheath component of a polyamide based hot melt adhesive in form of homopolymer, copolymer, terpolymer or polymer blends.

Core Composition

The predominant composition in the core component of the sheath-core bicomponent spandex fiber includes at least one segmented polyurethaneurea with the hard segment melt temperature no less than 250° C. The segmented polyurethaneurea is at least about 60% by weight of the core component. The core may be at least about 80% by weight of the fiber, such as about 80% to about 95% by weight of the fiber. A mixture or blend of two or more segmented polyurethaneureas can be used. Optionally, a mixture or blend of the segmented polyurethaneurea can also be used with another segmented polyurethane or other fiber forming polymers. Additives for various functions may be included in the core component as well.

The polyurethaneurea for the core component is made by a two-step process. In the first step, an isocyanate-terminated urethane prepolymer is formed by reacting a polymeric glycol with a diisocyanate. One suitable range for the molar ratio of the diisocyanate to the glycol is to control in a range of about 1.50 to 2.50. If desired, a catalyst can be used to assist the reaction in this prepolymerization step. In the second step, the urethane prepolymer is dissolved in a solvent such as N,N-dimethylacetamide (DMAc) and is chain extended with a short chain diamine or a mixture of diamines to form the polyurethaneurea solution. The polymer molecular weight of the polyurethaneurea is controlled by small amount of mono-functional alcohol or amine, typically less than 60 milliequivalent per kilogram of the polyurethaneurea solids, added and reacted in the first step and/or in the second step. The additives can be mixed into the polymer solution at any stage after the polyurethaneurea is formed but before the solution is spun into the fiber. The total additive amount in the fiber core component is typically less than 10% by weight. The solid content including the additives in the polymer solution prior to spinning is typically controlled in a range of 30.0% to 40.0% by weight of the solution. The solution viscosity is typically controlled in range from 2000 to 5000 poises for optimum spinning performance.

Suitable polymeric glycols for the polyurethaneurea in the core component include polyether glycols, polycarbonate glycols, and polyester glycols of number average molecular weight of about 600 to about 3,500. Mixtures of two or more polymeric glycol or copolymers can be included.

Examples of polyether glycols that can be used include those glycols with two terminal hydroxy groups, from ring-opening polymerization and/or copolymerization of ethylene oxide, propylene oxide, trimethylene oxide, tetrahydrofuran, and 3-methyltetrahydrofuran, or from condensation polymerization of a polyhydlic alcohol, such as a diol or diol mixtures, with less than 12 carbon atoms in each molecule, such as ethylene glycol, 1,3-propanediol, 1,4-butanediol, 1,5-pentanediol 1,6-hexanediol, 2,2-dimethyl-1,3 propanediol, 3-methyl-1,5-pentanediol, 1,7-heptanediol, 1,8-octanediol, 1,9-nonanediol, 1,10-decanediol and 1,12-dodecanediol. A linear, bifunctional polyether polyol is preferred, and a poly(tetramethylene ether)glycol with umber average molecular weight of about 1,700 to about 2,100, such as Terathane® 1800 (INVISTA of Wichita, Kans.) with a functionality of 2, is one example of the specific suitable glycols. Copolymers can include poly(tetramethylene ether co-ethylene ether)glycol and poly(2-methyl tetramethylene ether co-tetramethylene ether)glycol.

Examples of polyester glycols that can be used include those ester glycols with two terminal hydroxy groups, produced by condensation polymerization of aliphatic polycarboxylic acids and polyols, or their mixtures, of low molecular weights with no more than 12 carbon atoms in each molecule. Examples of suitable polycarboxylic acids are malonic acid, succinic acid, glutaric acid, adipic acid, pimelic acid, suberic acid, azelaic acid, sebacic acid, undecanedicarboxylic acid, and dodecanedicarboxylic acid. Examples of suitable glycols for preparing the polyester polyols are ethylene glycol, 1,3-propanediol, 1,4-butanediol, 1,5-pentanediol 1,6-hexanediol, neopentyl glycol, 3-methyl-1,5-pentanediol, 1,7-heptanediol, 1,8-octanediol, 1,9-nonanediol, 1,10-decanediol and 1,12 dodecanediol. A linear bifunctional polyester polyol with a melting temperature of about 5° C. to about 50° C. is an example of a specific polyester glycol.

Examples of polycarbonate glycols that can be used include those carbonate glycols with two terminal hydroxyl groups, produced by condensation polymerization of phosgene, chloroformic acid ester, dialkyl carbonate or diallyl carbonate and aliphatic polyols, or their mixtures, of low molecular weights with no more than 12 carbon atoms in each molecule. Examples of suitable polyols for preparing the polycarbonate polyols are diethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polycarbonate polyol with a melting temperature of about 5° C. to about 50° C. is an example of a specific polycarbonate polyol.

The diisocyanate component used to make the polyurethaneurea can include a single diisocyanate or a mixture of different diisocyanates including an isomer mixture of diphenylmethane diisocyanate (MDI) containing 4,4'-methylene bis(phenyl isocyanate) and 2,4'-methylene bis(phenyl isocyanate). Any suitable aromatic or aliphatic diisocyanate can be included. Examples of diisocyanates that can be used include, but are not limited to 4,4'-methylene bis(phenyl isocyanate), 4,4'-methylenebis(cyclohexyl isocyanate), 1,4-xylenediisocyanate, 2,6-toluenediisocyanate, 2,4-toluenediisocyanate, and mixtures thereof. Examples of specific polyisocyanate components include Takenate® 500 (Mitsui Chemicals), Mondur® MB (Bayer), Lupranate® M (BASF), and Isonate® 125 MDR (Dow Chemical), and combinations thereof.

Examples of suitable diamine chain extenders for making the polyurethaneurea include: 1,2-ethylenediamine; 1,4-butanediamine; 1,2-butanediamine; 1,3-butanediamine; 1,3-diamino-2,2-dimethylbutane; 1,6-hexamethylenediamine; 1,12-dodecanediamine; 1,2-propanediamine; 1,3-propanediamine; 2-methyl-1,5-pentanediamine; 1-amino-3,3,5-trimethyl-5-aminomethylcyclohexane; 2,4-diamino-1-methylcyclohexane; N-methylamino-bis(3-propylamine); 1,2-cyclohexanediamine; 1,4-cyclohexanediamine; 4,4'-methylene-bis(cyclohexylamine); isophorone diamine; 2,2-dimethyl-1,3-propanediamine; meta-tetramethylxylenediamine; 1,3-diamino-4-methylcyclohexane; 1,3-cyclohexane-diamine; 1,1-methylene-bis(4,4'-diaminohexane); 3-aminomethyl-3,5,5-trimethylcyclohexane; 1,3-pentanediamine(1,3-diaminopentane); m-xylylene diamine; and Jeffamine® (Texaco). Optionally, water and tertiary alcohols such as tert-butyl alcohol and α-Cumyl alcohol can also be used as chain extenders to make the polyurethaneurea.

A monofunctional alcohol or a primary/secondary monofunctional amine can be included as a chain terminator to control the molecular weight of the polyurethaneurea. Blends of one or more monofunctional alcohols with one or more monofunctional amines may also be included.

Examples of monofunctional alcohols useful as a chain terminator with the present invention include at least one member selected from the group including aliphatic and cycloaliphatic primary and secondary alcohols with 1 to 18 carbons, phenol, substituted phenols, ethoxylated alkyl phenols and ethoxylated fatty alcohols with molecular weight less than about 750, including molecular weight less than 500, hydroxyamines, hydroxymethyl and hydroxyethyl substituted tertiary amines, hydroxymethyl and hydroxyethyl substituted heterocyclic compounds, and combinations thereof, including furfuryl alcohol, tetrahydrofurfuryl alcohol, N-(2-hydroxyethyl)succinimide, 4-(2-hydroxyethyl) morpholine, methanol, ethanol, butanol, neopentyl alcohol, hexanol, cyclohexanol, cyclohexanemethanol, benzyl alcohol, octanol, octadecanol, N,N-diethylhydroxylamine, 2-(diethylamino) ethanol, 2-dimethylaminoethanol, and 4-piperidineethanol, and combinations thereof. Preferably, such a monofunctional alcohol is reacted in the step of making the urethane prepolymer to control the polymer molecular weight of polyurethaneurea formed at a later step.

Examples of suitable monofunctional primary amines useful as a chain terminator for the polyurethaneurea include, but are limited to, ethylamine, propylamine, isopropylamine, n-butylamine, sec-butylamine, tert-butylamine, isopentylamine, hexylamine, octylamine, ethylhexylamine, tridecylamine, cyclohexylamine, oleylamine and stearylamine. Examples of suitable monofunctional dialkylamine chain blocking agents include: N,N-diethylamine, N-ethyl-N-propylamine, N,N-diisopropylamine, N-tert-butyl-N-methylamine, N-tert-butyl-N-benzylamine, N,N-dicyclohexylamine, N-ethyl-N-isopropylamine, N-tertbutyl-N-isopropylamine, N-isopropyl-N-cyclohexylamine, N-ethyl-N-cyclohexylamine, N,N-diethanolamine, and 2,2,6,6-tetramethylpiperidine. Preferably, such a monofunctional amine is used during the chain extension step to control the polymer molecular weight of the polyurethaneurea. Optionally, amino-alcohols such as ethanolamine, 3-amino-1-propanol, isopropanolamine and N-methylethanolamine can also be used to regulate the polymer molecular weight during the chain extension reaction.

Sheath Composition

The heat sensitive sheath component of the sheath-core bicomponent spandex fiber provides the fiber with the ability fuse and bond the spandex fiber and the polymer fiber such as nylon fiber together following heat treatment. This sheath layer should include a sufficient amount of the polyamide hot melt adhesive to be able to wet the contact surface and develop adhesion to the polymer filament such as nylon filaments; it should also be compatible with the spandex polymer. The bonding strength will ideally be adequate to withstand the repeated wearing, washing, drying and cleaning of the fabrics and garments. Based on extensive screening and comparing of a wide range of hot melt adhesives including those thermoplastics based on vinyl acetate copolymers, acrylate copolymers, styrene block copolymers, polyamides, polyesters and polyurethanes, polyamide hot melt adhesive is selected as one of the major ingredients for the sheath composition.

According to the present invention, the content of the polyamide hot melt adhesive in the sheath is at least 25% by weight of the sheath component in order to develop adequate bonding between the spandex fiber and a nylon fiber. Further, according to the present invention, the melting temperature of the polyamide hot melt adhesive is not higher than about 180° C., including from about 120 to about 180° C., and about 120 to about 160° C. to maintain the sensitivity to heat treatment. Other polymers and additives are included in the sheath component as well.

A range of amounts for the inclusion of polyamide hot melt adhesive in the sheath are suitable. For example, the polyamide hot melt adhesive may be present in an amount of up to about 80% by weight of the sheath composition. This includes about 20% to about 80% by weight of the sheath composition.

The selected polyamide hot melt adhesive can be a homopolymer, copolymer, terpolymer, multipolymer or a polymer blend or mixture, including block copolymers such as polyetheresteramide and polyesteramide. N-substituted polyamides, either partially substituted or completely substituted, can also be used as the hot melt adhesives.

The polyamide base polymer in the hot melt adhesive can be made by condensation polymerization of selected diamines and dibasic acids, condensation polymerization of selected ω-amino acids and ring-opening polymerization of lactams. Examples of dibasic acids include but are not limited to adipic acid, azelaic acid, sebacic acid, dodecanedioic acid and dimer acid; Examples of diamines include but are not limited to hexamethylenediamine, trimethylhexamethylenediamine, 1,5-diamino-2-methylpentane, 1,3-cyclohexanediamine, 1,12-diaminododecane, 1-(2-aminoethyl) piperazine and 1,4-bis(3-aminopropyl)piperazine. Examples of ω-amino acids are 11-aminoundecanoic acid and 12-aminododecanoic acid. Examples of lactams are ε-caprolactam and ω-laurolactam.

Examples of suitable and commercially available polyamide hot melt adhesives include, but are not limited to, those under the trade names of UNI-REZ™ (Arizona Chemical), VESTAMELT® (Evonik), Macromelt® (Henkel), Platamid® (Arkema), Euremelt® (Huntsman), Elvamide® (DuPont), Griltex® (EMS-Griltech), VERSAMID® (Cognis) and Isocor™ (Jarden Applied Materials).

The polymer solution for the sheath component is typically prepared by dissolving the polyamide hot melt adhesive, supplied in form of block, pellet or powder, in a solvent such as N,N-dimethylacetamide (DMAc) in combination with other thermoplastic polymers such as vinyl acetate copolymers, acrylate copolymers, styrene block copolymers, polyesters and polyurethanes. To accelerate the dissolving process, heat can be applied either through external heating media or by high speed mechanical agitation. Optionally, alkali and alkali-earth metal salts selected from lithium chloride, lithium bromide, lithium nitrate, calcium chloride and magnesium chloride can be used to assist the solubility of the polyamide hot melt adhesive and to promote the solution viscosity stability in DMAc. Additives for various functions are often included in the sheath component as well. The solid content including the additives in the sheath polymer solution prior to spinning is typically controlled in a range of 25.0% to 45.0% by weight of the solution. The solution viscosity is typically controlled in range from 1000 to 5000 poises for optimum spinning performance.

Additives

Classes of additives that may be optionally included in the sheath and/or core component of the bicomponent spandex fiber are listed below. An exemplary and non-limiting list is included. However, additional additives are well-known in the art. Examples include: antioxidants, UV stabilizers, colorants, pigments, cross-linking agents, phase change materials (paraffin wax), antimicrobials, minerals (i.e., copper), microencapsulated additives (i.e., aloe vera, vitamin E gel, aloe vera, sea kelp, nicotine, caffeine, scents or aromas), nanoparticles (i.e., silica or carbon), calcium carbonate, flame retardants, antitack additives, chlorine degradation resistant additives, vitamins, medicines, fragrances, electrically conductive additives, dyeability and/or dye-assist agents (such as quaternary ammonium salts).

Other additives which may be added to the include adhesion promoters and fusibility improvement additives, anti-static agents, anti-creep agents, optical brighteners, coalescing agents, electroconductive additives, luminescent additives, lubricants, organic and inorganic fillers, preservatives, texturizing agents, thermochromic additives, insect repellants, and wetting agents, stabilizers (hindered phenols, zinc oxide, hindered amine), slip agents (silicone oil) and combinations thereof.

The additive may provide one or more beneficial properties including: dyeability, hydrophobicity (i.e., polytetrafluoroethylene (PTFE)), hydrophilicity (i.e., cellulose), friction control, chlorine resistance, degradation resistance (i.e., antioxidants), adhesiveness and/or fusibility (i.e., adhesives and adhesion promoters), flame retardance, antimicrobial behavior (silver, copper, ammonium salt), barrier, electrical conductivity (carbon black), tensile properties, color, luminescence, recyclability, biodegradability, fragrance, tack control (i.e., metal stearates), tactile properties, setability, thermal regulation (i.e., phase change materials), nutriceutical, delustrant such as titanium dioxide, stabilizers such as hydrotalcite, a mixture of huntite and hydromagnesite, UV screeners, and combinations thereof.

Additives may be included in any amount suitable to achieve the desired effect.

Other Polymers

Other polymers that are useful with the bicomponent fibers of the present invention include other polymers which are soluble or have limited solubility or can be included in particulate form. The polymers may be dispersed or dissolved in the sheath and/or core polymer solution and are extruded as part of the fiber.

Examples of other polymers include thermoplastic polymers such as vinyl acetate copolymers, acrylate copolymers, styrene block copolymers, maleic anhydride copolymers, polyesters and polyurethanes.

Fiber Formation

The apparatus and process for spinning the sheath-core bicomponent spandex fiber by solution spinning including dry spinning method are known and disclosed in U.S. patent applications 20120034834A1 and 20110275265A1, which are incorporated by reference in their entirety.

The article of some aspects may be a yarn, fabric or garment. The article includes a polymer yarn, such as a polyamide yarn and a sheath-core bicomponent spandex.

The fabric includes a knit, woven or non-woven fabric that includes a sheath-core bicomponent spandex with a polyamide hot melt adhesive in the sheath. The spandex filaments will have a direct contact point with a polymer filament such are nylon or polyester filaments. The knitted fabrics can be made by weft knitting or warp knitting methods, including those fabric constructions produced by circular knitting machine, seamless knitting machine, tricot knitting machine and raschel knitting machine, among others. Accordingly, the knit may be circular knit, seamless, flat knit, raschel, tricot, jersey, etc. The woven fabrics can be made by weaving a polymer fiber such as nylon or polyester fiber with a bicomponent spandex fiber or where the bicomponent spandex fiber is covered with another fiber or yarn, such as a nylon-covered spandex.

The nylon fibers used in the fabrics of some aspects are those polyamide based fibers with at least one melting temperature above 180° C., examples of the nylon fibers include but are not limited to nylon 6, nylon 6/6, nylon 4/6, nylon 6/10 and nylon 6/12. Optionally, bicomponent nylon fibers, either sheath-core configuration or side-by-side configuration can be used for the fabrics as well. Further, in such kind of bicomponent fiber, one of the components includes a polyamide hot melt adhesive.

The bicomponent spandex fiber used in the article can be in the form of bare yarn or in the form of nylon-covered spandex yarns. In the fabrics, the spandex content is in a range of about 1% to 35% by weight of the fabrics, such as about 2% to about 25%, by weight of the fabric.

When the fabrics of some aspects are subjected to heat treatment, such as a heat-setting process, the fabrics can develop fused contact points or segments between polymer filament, such as nylon filaments, and the bicomponent spandex filaments. The heat-setting temperature may be chosen to provide at least a partial fusing of the polymer filament and the bicomponent spandex filament. The heat treatment may include subjecting the fabrics to temperature in a range of 120° C. to 210° C. Suitable ranges include about 120° C. to about 180° C., about 150° to about 165° C., about 160° C. to about 180° C. and about 180° to 200° C. The fused contact points or segments include at least one polyamide hot melt adhesive. Such finished fabrics will have enhanced fabric stretch and recovery power, and have reduced slippage of spandex yarn from the seam or cut-open edges.

The features and advantages of the present invention are more fully shown by the following examples which are provided for purposes of illustration, and are not to be construed as limiting the invention in any way.

EXAMPLES

Test Methods

The viscosity of the polymer solutions for the sheath and the core components was determined in accordance with the method of ASTM D1343-69 with a Model DV-8 Falling Ball Viscometer (Duratech Corp., Waynesboro, Va.), operated at 40° C. and reported as poises.

The solid content in the polymer solutions for the sheath and the core components was measured by a microwave heated moisture/solids analyzer, Smart System 5 (CEM Corp. (Matthews, N.C.).

Percent isocyanate (% NCO) of the capped glycol prepolymer was determined according to the method of S. Siggia. "Quantitative Organic Analysis via Functional Group", 3rd Edition, Wiley & Sons, New York, pages 559-561 (1963) using a potentiometric titration.

The melting temperature of the polymer used in the sheath and the core components was determined by a differential scanning calorimeter (DSC), Model Q1000 (TA Instruments—Water LLC, New Castle, Del.). The heating rate was set at 10° C. per minute in nitrogen atmosphere, the endothermic peak position was used as the melting temperature of the hard segment domains for the segmented polyurethanes and for the crystalline phase of other thermoplastic polymers including the polyamide hot melt adhesives.

The strength and elastic properties of the spandex and films were measured in accordance with the general method of ASTM D 2731-72. Three filaments, a 2-inch (5-cm) gauge length and a 0-300% elongation cycle were used for each of the measurements. The samples were cycled five times at a constant elongation rate of 50 centimeters per minute. Load power, the stress on the spandex during initial extension, was measured on the first cycle at 200% extension and is reported as gram-force for a given denier. Unload power is the stress at an extension of 200% for the fifth unload cycle and is also reported in gram-force. Percent elongation at break and tenacity were measured on a sixth extension cycle. Percent set was also measured on samples that had been subjected to five 0-300% elongation/relaxation cycles. The percent set, % S, was then calculated as:

$$\% S=100(L_f-L_o)/L_o$$

where Lo and Lf are respectively the filament (yarn) length when held straight without tension before and after the five elongation/relaxation cycles.

The yarn fusibility of the inventive spandex to polymer filament was measured by mounting a 15 cm long sample of the inventive spandex on an adjustable frame in triangle shape with the vertex centered at the frame and two equal side lengths of 7.5 cm. A nylon filament of the same length is mounted on the frame from the opposite side such that the two yarns intersect and crossover with a single contact point. Fibers are relaxed to 5 cm, then exposed to scouring bath for one hour, rinsed, air-dried, and subsequently exposed to a dye bath for 30 minutes, rinsed, and air-dried. The frame with fibers is adjusted from 5 cm to 30 cm in length, and exposed to a specified temperature, e.g., at 180° C. for 30 seconds, cooled for 3 minutes, and relaxed. Yarns are removed from the frame and transferred to tensile testing machine with each yarn clamped by one end leaving the contact point positioned between the clamps. Yarns are extended at 100%/min and the force to break (gram-force) the contact point is recorded as the fusing strength.

The seam slippage resistance of the inventive spandex in a nylon fabric was measure by the force pulling the spandex fiber out of a knitted fabric. A Raschel fabric is prepared with a spandex of which the seam slippage resistance must be defined. A sample is cut with a dimension of 24 cm in the direction of the laid-in spandex, and 5 cm in the perpendicular direction. This sample fabric must be prepared according FIG. 1.

The spandex fibers must be exposed so that they can be pulled out. The sample area includes 10 spandex fibers which are used as follows:

- the 1st, 4th, 7th and 10th fiber are used for measuring the adhesive strength by a stress-strain analyzer
- the 2nd, 3rd, 5th, 6th, 8th and 9th are cut away One of the freed fibers is clamped in the moving clamp of a stress-strain analyzer. The static clamp is used to secure the fabric end, making sure that the cut area A is outside the clamp. The stress-strain analyzer is used to pull out the fiber at a speed of 100/min, while measuring and recording the result force for this. With the described sample preparation, this method can be repeated 3 times with the remaining freed fibers.

The resulting graphs will give an increase of the force and an oscillating pattern as a result of the breaking of the fusing points, till the point when the fiber is completely pulled out of the fabric. The maximum force, as well the amplitude of the oscillating patter will give an indication of the seam slippage resistance. Comparison of the results of this test and the performance of garments from fabric, knit with known spandex allows making a qualitative prediction of the seam slippage resistance.

LYCRA® fiber referred to herein, including but not limited to T162C, T162B, and T269 referred to herein, are available from INVISTA Wichita, Kans.

EXAMPLES

Example 1

Core Component

The polymer solution of the core component was prepared by making a polyurethaneurea in DMAc solvent with a two-step polymerization process, followed by mixing of a slurry of additives with the polymer solution. In the first step polymerization or prepolymerization, 100.00 parts of Terathane® 1800 glycol was reacted with 23.46 parts of Isonate® 125 MDR to form a prepolymer or a capped glycol with isocyanate terminal groups. The concentration of the isocyanate groups in the formed prepolymer was at 2.60% by weight of the prepolymer. The prepolymer was then dissolved in DMAc by high speed mixing to have a solution about 45% solids by weight. This diluted prepolymer was further reacted with a DMAc solution containing a mixture of ethylenediamine (EDA) and 2-methylpentanediamine with a molar ratio of 90 to 10 and N,N-diethylamine to form the polyurethaneurea polymer solution with about 35.0% solids by weight. The polyurethaneurea polymer had both primary amine terminal groups and diethylurea end groups, their ratio was generally controlled in a range between 1:1 to 1:3. The intrinsic viscosity of the polymer was typically in a range of 0.95 dL/g to 1.20 dL/g. The hard segment melting temperature of this polymer measured by DSC was at 285° C.

This polymer solution was mixed with a slurry with various additives in DMAc so that the core component of the final spandex contained 4.0 wt % huntite/hydromagnesite, 0.3 wt % titanium dioxide, less than 15 ppm blue toner, 1.5 wt % Irganox® 245, 0.5 wt % Methacrol® 2462B, and 0.6 wt % silicone oil.

Sheath Component:

The polymer solution of the sheath component was prepared by mixing and dissolving the following materials in DMAc in a nitrogen blanketed container at 90° C. for 4 hours.

| | |
|---|---|
| Isocor ™ SVP-651 nylon terpolymer resin | 100.00 parts |
| Desmopan ® 5733 TPU resin | 78.00 parts |
| Polyurethaneurea Solution (Example 1) | 62.00 parts |
| Cellulose Acetate Butyrate (CAB-551-0.2) | 8.75 parts |
| Lithium Chloride | 8.00 parts |
| N,N-Dimethylacetamide (DMAc) | 343.75 parts |

Fiber Spinning:

The polymer solutions for the core component and the sheath component were metered and spun into a 70 denier 5 filament sheath-core bicomponent fiber according to the method disclosed in U.S. Patent Application 2012/0034834 A1. The core component was 88 wt % and the sheath component was 12 wt % in each filament of the fiber. The strength and elastic properties as well as the fusibility to nylon fiber were measured.

Comparative Example 1

A 70 denier 5 filament spandex fiber was made in a similar way except using only the core polymer solution as described in Example 1. The strength and elastic properties as well as the fusibility to nylon fiber were measured.

Example 2

The core component was the same as described in Example 1, the sheath polymer solution was prepared including the following:

| | |
|---|---|
| Isocor ™ SVP-651 nylon terpolymer resin | 100.00 parts |
| Desmopan ® 5733 TPU resin | 100.00 parts |
| Irganox ® 245 | 2.67 parts |
| N,N-Dimethylacetamide (DMAc) | 360.00 parts |

The polymer solutions for the core component and the sheath component were metered and spun into a 20 denier 2 filament sheath-core bicomponent fiber. The strength and elastic properties as well as the fusibility to nylon fiber were measured.

Example 3

The core component was the same as described in Example 1, the sheath polymer solution was prepared including the following:

| | |
|---|---|
| VESTAMELT ® 742 Dried | 100.00 parts |
| Desmopan ® 5733 TPU resin | 226.67 parts |
| Cellulose Acetate Butyrate (CAB-551-0.2) | 10.50 parts |
| Lithium Chloride | 6.67 parts |
| N,N-Dimethylacetamide (DMAc) | 628.33 parts |

The polymer solutions for the core component and the sheath component were metered and spun into a 20 denier 2 filament sheath-core bicomponent fiber. The strength and elastic properties as well as the fusibility to nylon fiber were measured as shown in Table 1.

TABLE 1

| Example | Item | Denier/ Filament | Tenacity g | Elongation % | Load Power at 200%, g | Unload Power at 200%, g | Set % | Fusibility to Nylon, g | Fused Elongation % | Fusing Conditions |
|---|---|---|---|---|---|---|---|---|---|---|
| 1 | 270C14 | 70/5 | 52.3 | 470 | 8.10 | 1.94 | 27.9 | 7.90 | 91.3 | 180° C. 60 seconds |
| 2 | 270C20 | 20/2 | 21.2 | 416 | 3.13 | 0.60 | 30.1 | 3.45 | 96.0 | 180° C. 60 seconds |
| 3 | 270J20 | 20/2 | 22.0 | 387 | 3.64 | 0.59 | 29.0 | 1.47 | 52.0 | 160° C. 60 seconds |
| Com. Ex. | | 70/5 | | | | | | No Fusing at all | | 180° C. 60 seconds |

Example 4

A Raschel fabric is made with 78 dtex spandex and two PA 6 fibres (20d/9f and 30d/12f). The control fabric is made with 78 dtex T269B, the test fabric with 70d fibre of this invention. Fabrics are heat set on a Stenter machine at 180° C. at 30 m/min., giving an exposure time of 40 sec.

The two resulting fabrics are analyzed by the method as described above.

The following results are achieved, as given in Table 2 below:

TABLE 2

| | 70d T269B | 70d Example 1 spandex |
|---|---|---|
| Maximum peak force (N) | 0.100 | 0.280 |
| Amplitude oscillating part (N) | 0.012 | 0.042 |

Maximum peak force of 0.1 N are considered as values that has seam slippage propensity in a light weight fabrics of this example, a value above 0.2 are considered to give a reduction of seam slippage.

WOVEN FABRIC EXAMPLES

For each of the following four examples, 100% cotton staple spun yarn is used as warp yarn. They included two count yarns: 7.0 Ne OE yarn and 8.5 Ne OE yarn with irregular arrangement pattern. The yarns were indigo dyed in rope form before beaming. Then, they were sized and were made the weaving beam.

The spandex of example 1 (Ex. 1 spandex)/cotton core spun yarns and Ex. 1 spandex elastic fiber/Polyester textured air covered yarns were used as weft yarn. Table 1 lists the materials and process conditions that were used to manufacture the core spun yarns and air covered yarn for each example. For example, in the column headed elastic fiber 70d means 70 denier; and 3.7× means the draft of the elastic imposed by the core spinning machine (machine draft). In the column headed 'Hard Yarn', 10's is the linear density of the spun yarn as measured by the English Cotton Count System. The rest of the items in Table 3 are clearly labeled.

Stretch woven fabrics were subsequently made, using the core spun yarn and air covered yarn of each example in Table 3. The core spun yarns and air covered yarns were used as weft yarns. Table 4 summarizes the yarns used in the fabrics, the weave pattern, and the quality characteristics of the fabrics. Some additional comments for each of the examples are given below. Unless otherwise noted, the fabrics were woven on a Donier air-jet loom. Loom speed was 500 picks/minute. The widths of the fabric were about 76 and about 72 inches in the loom and greige state, respectively.

Each greige fabric in the examples was finished by: scouring, desizing, relaxation and adding softener.

TABLE 3

Weft Yarn Specification

| Example | Elastane Fiber Dtex (Denier) | LY-CRA ® fiber Type | LY-CRA ® fiber Draft | Hard Yarn | Yarn twist per inch interlacing or points per yard |
|---|---|---|---|---|---|
| 5 | 77 dtex (70D) | T162C | 3.9X | 10'S cotton | 12.5 turns |
| 6 | 77 dtex (70D) | Ex. 1 Spandex | 3.9X | 10's cotton | 12.5 turns |
| 7 | 77 dtex (70D) | T162C | 3.3X | 300D/192f textured polyester | 86 points |
| 8 | 77 dtex (70D) | Ex. 1 Spandex | 3.3X | 300D/192f textured polyester | 86 points |

TABLE 4

Woven Fabric Properties

| Example | Weft yarn | Warp yarn | Weave pattern | Fabric on loom (warp EPI × weft PPI) | Fabric weight oz/yd2 | Fabric stretch % | Fabric growth % | Fabric recovery force at 12% extension |
|---|---|---|---|---|---|---|---|---|
| 5 | 10'cotton/70D T162C 3.9X CSY | 7.75s 100% cotton OE Indigo | ⅓ twill | 76 × 40 | 14.05 | 59.4 | 9.5 | 357.7 |
| 6 | 10' cotton/70D Ex. 1 spandex 3.9X CSY | 7.75s 100% cotton OE Indigo | ⅓ twill | 76 × 40 | 14.01 | 56.2 | 9.1 | 383.6 |
| 7 | 300D polyester/T162C AJY | 7.75s 100% cotton OE Indigo | ⅓ twill | 76 × 54 | 11.6 | 47.6 | 2 | 580.8 |
| 8 | 300D polyester/ 70D Ex. 1 spandex AJY | 7.75s 100% cotton OE Indigo | ⅓ twill | 76 × 54 | 11.53 | 45.8 | 2 | 588.3 |

Example 5: Stretch Denim with Normal Elastic CSY

This is a comparison example, not according to the invention. The warp yarn was 7.0 Ne count and 8.4 Ne count mixed open end yarn. The warp yarn was indigo dyed before beaming. The weft yarn is 10Ne core spun yarn with 70D T162C Lycra® spandex. The Lycra® fiber was drafted 3.9× during covering process. Table 4 lists the fabric properties. This fabric had weight (14.05 g/m$^2$), stretch (59.4%), growth (9.5%) and recovery power under 12% extension (357.7 grams).

Example 6: Stretch Denim Containing Elastic CSY

This sample had the same fabric structure as example 5. The difference was the core spun yarn in weft direction, which contains 70D Ex. 1 spandex. This fabric used the same warp and structure as Example 5. Also, the weaving and finishing process were the same as Example 5. Table 4 summarizes the test results. We can see that this sample had low fabric growth (9.1%) and high recovery power (383.6 grams) than fabrics in example 5.

Example 7: Stretch Denim with Normal Elastic AJY

This is a comparison example, not according to the invention. The warp yarn was 7.0 Ne count and 8.4 Ne count mixed open end yarn. The warp yarn was indigo dyed before beaming. The weft yarn is 300d/192 filaments polyester air covered yarn with 70D T162C Lycra® spandex. The Lycra® fiber was drafted 3.3× during covering process. Table 2 lists the fabric properties. This fabric had weight (11.6 g/m$^2$), stretch (47.6%), growth (2%) and recovery power under 20% extension (580.8 grams).

Example 8: Stretch Denim Containing Elastic AJY

This sample had the same fabric structure as example 7. The difference was the core spun yarn in weft direction, which contains 70D Ex. 1 spandex. This fabric used the same warp and structure as Example 7. Also, the weaving and finishing process were the same as Example 3. Table 4 summarizes the test results. We can see that this sample had low fabric growth (2%) and high recovery power (588.3 grams) than fabrics in example 7.

Circular Knit Fabric Examples with Fiber

To make the four example fabrics that follow (Examples 9-12), two different nylon yarns were used: A first flat nylon 6,6 with a denier of 140 and filament count of 34 manufactured by INVISTA, S. á r. I. of Wichita, Kans., and a second false twist textured nylon 6,6 with a denier of 156 and a filament count of 136 manufactured by INVISTA. These were individually combined with a 70 denier Ex. 1 spandex or a 70 denier T162B LYCRA® spandex yarn manufactured by INVISTA, which is a standard spandex yarn, used as a control comparison in the examples.

One each of a spandex yarn and nylon yarn were knit simultaneously on a single jersey circular knitting machine with the specifications of 28 cut, 26 inch diameter with 42 feeds and knitting at 16 revolutions per minute, using an every-course plaiting feed, to produce the 4 example stretch fabrics as detailed in TABLE 5.

TABLE 5

| Example | Spandex Yarn Denier | Spandex Yarn Type | Spandex Yarn Draft | Spandex Yarn Content | Hard Yarn Type | Hard Yarn Content |
|---|---|---|---|---|---|---|
| 9 | 70 | Ex. 1 spandex | 3.0X | 14.3% | 140/34 Flat Nylon 6,6 | 85.7% |
| 10 | 70 | T162B | 3.0X | 14.3% | 140/34 Flat Nylon 6,6 | 85.7% |
| 11 | 70 | Ex. 1 spandex | 3.0X | 13.4% | 156/136 Textured Nylon 6,6 | 86.6% |
| 12 | 70 | T162B | 3.0X | 13.4% | 156/136 Textured Nylon 6,6 | 86.6% |

Each of these fabrics was then finished using a scour, heat set, dye and dry process. Specifically, these fabrics were heat set at 375° Fahrenheit for 45 seconds at a width of 54 inches. They were then dyed white in a jet dyeing machine at 210° Fahrenheit and dried at 250 Fahrenheit for 45 seconds at a width of 54 inches. The completed example fabrics had the properties as detailed in TABLE 6.

TABLE 6

| Example | Spandex Yarn Type | Hard Yarn Type | Weight, grams per square meter | Wales per inch | Courses per inch | Recovery power at 50% elongation, length direction | Recovery power at 50% elongation, width direction |
|---|---|---|---|---|---|---|---|
| 9 | Ex. 1 spandex | 140/34 Flat Nylon 6,6 | 318 | 42 | 86 | 564.6 | 633.0 |
| 10 | T162B | 140/34 Flat Nylon 6,6 | 323 | 42 | 87 | 468.0 | 543.7 |
| 11 | Ex. 1 spandex | 156/136 Textured Nylon 6,6 | 319 | 42 | 80 | 571.4 | 571.6 |
| 12 | T162B | 156/136 Textured Nylon 6,6 | 330 | 42 | 82 | 480.7 | 509.1 |

The recovery power was measured using an INSTRON CRE machine, using a 3 inch by 8 inch specimen with the long dimension cut in the indicated fabric direction. These specimens were folded and sewn into 3 inch loops. These loops were elongated on the CRE machine 3 times to 100% total elongation and the 50% recovery power measurement was taken after the third cycle to 100%.

Example 9: Stretch Circular Knit Fabric Containing Ex. 1 Spandex

This fabric is of a single jersey circular knit construction and was made using 70 denier Ex. 1 spandex and a 140 denier 34 filament flat nylon 6,6. The fabric properties are summarized in TABLE 6.

Example 10: Stretch Circular Knit Fabric Containing Standard Spandex

This is a comparison fabric to Example 9 and not of the present invention. This fabric is of the same construction and contains 70 denier T162B LYCRA® fiber and the same nylon yarn as Example 9. The fabric properties are summarized in TABLE 6. It can be seen that the fabric weight, wale and course counts are similar, but the recovery power in both the fabric length and width directions is less for this fabric than Example 9 (17% and 14% less, respectively).

Example 11: Stretch Circular Knit Fabric Containing Ex. 1 Spandex

This fabric is of a single jersey circular knit construction and was made using 70 denier Ex. 1 spandex and a 156 denier 136 filament textured nylon 6,6. The fabric properties are summarized in TABLE 6.

Example 12: Stretch Circular Knit Fabric Containing Standard Spandex

This is a comparison fabric to Example 11 and not of the present invention. This fabric is of the same construction and contains 70 denier T162B LYCRA® spandex yarn and the same nylon yarn as Example 11. The fabric properties are summarized in TABLE 6. It can be seen that the fabric weight, wale and course counts are similar, but the recovery power in both the fabric length and width directions is less for this fabric than Example 11 (16% and 11% less, respectively).

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. An article comprising a fusible bicomponent spandex yarn consisting of:

(a) a polyurethane bicomponent fiber including a cross-section having a core and a sheath; wherein said sheath consists of a polyamide-based hot melt adhesive and polyurethane composition selected from a polyurethane, a polyurethane-urea or a blend of polyurethane and polyurethane-urea, wherein said core and said sheath include independently selected polyurethane compositions, and wherein said core includes at least 60% by weight of segmented polyurethaneurea with a hard segment melt temperature no less than 250° C.; and (b) a nylon fiber fused to the bicomponent spandex yarn via the polyamide-based hot melt adhesive.

2. The article of claim 1, wherein said core and said sheath both include a polyurethane-urea.

3. The article of claim 1, wherein said bicomponent spandex is solution-spun.

4. The article of claim 1, wherein said core and said sheath independently include:

(1) a polyurethane, (2) a blend of at least one polyurethane and at least one polyurethane-urea or, (3) a polyurethane-urea.

5. The article of claim 1, wherein said core is heat resistant and said sheath is heat sensitive.

6. The article of claim 1, wherein said core is at least 80% by weight of said fiber.

7. The article of claim 1, wherein said core is 80% to 95% by weight of said fiber.

8. The article of claim 1, wherein said hot melt adhesive has a melting temperature less than 180° C.

9. The article of claim 1, wherein said hot melt adhesive has a melting temperature of 120° C. to 180° C.

10. The article of claim 1, wherein said hot melt adhesive is present in the sheath in an amount greater than 20%.

11. The article of claim 1, wherein said hot melt adhesive is present in the sheath in an amount of 20% to 80%, by weight of the sheath.

12. The article of claim 1, wherein the core and sheath of the fiber are extruded through the same capillary into a single filament.

13. The article of claim 1, wherein said fiber is solution-spun.

14. The article of claim 1, wherein said cross-section is non-round.

15. The article of claim 1, wherein said article is a fabric.

16. The article of claim 15, wherein said fabric is woven, nonwoven or knit.

17. The article of claim 1, wherein said bicomponent spandex is covered with another yarn.

* * * * *